US006945619B1

(12) United States Patent
Chen et al.

(10) Patent No.: US 6,945,619 B1
(45) Date of Patent: Sep. 20, 2005

(54) POSITIONING DEVICE FOR A SLIDE

(75) Inventors: Ken-Ching Chen, Kaohsiung Hsien (TW); Shih-Long Hwang, Kaohsiung Hsien (TW); Shun-Ho Yang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/917,475

(22) Filed: Aug. 13, 2004

(51) Int. Cl.[7] ..... A47B 88/04
(52) U.S. Cl. ..... 312/334.47; 312/334.44
(58) Field of Search ..... 312/330.1, 333, 312/334.1, 334.7, 334.8, 334.11, 334.44, 312/334.46, 337.47; 384/18, 21, 22

(56) References Cited

U.S. PATENT DOCUMENTS 4,560,212 A * 12/1985 Papp et al. ..... 384/18
6,367,899 B1 4/2002 Hwang et al.
6,375,290 B1 * 4/2002 Lin et al. ..... 312/334.46
6,412,891 B1 7/2002 Liang et al.

FOREIGN PATENT DOCUMENTS

| | | | |
|---|---|---|---|
| NO | 67200 | * 12/1943 | ..... 312/334.44 |
| TW | 215620 | 11/2003 | |
| TW | 216738 | 12/2003 | |
| TW | 216739 | 12/2003 | |
| TW | 092206231 | 6/2004 | |

* cited by examiner

*Primary Examiner*—James O. Hansen
(74) *Attorney, Agent, or Firm*—Rosenberg, Klein & Lee

(57) ABSTRACT

A positioning device for a slide includes a mobile track, a fixed track, and an auxiliary slide panel. A transient restriction of the mobile track is created by means of a slide piece for restriction and a retainer. The mobile track is then pushed into the fixed track by force for the slide piece to automatically slide and retreat to depart from the restriction by the retainer for fast retraction of the mobile track.

4 Claims, 6 Drawing Sheets

POSITIONING DEVICE FOR A SLIDE

BACKGROUND OF THE INVENTION (a) Field of the Invention

The present invention relates to a positioning device for a slide, and more particularly, to one provides a transient positioning for a mobile track in relation to a fixed track when the mobile track is extended and later the positioning is automatically released by applying a certain push force to the mobile track.

(b) Description of the Prior Art

When a mobile track is pulled out from a slide designed with better functionality that is generally available in the market, the mobile track is usually very difficult to be retracted into a fixed track of a slide due to the disposition of a positioning device at where the mobile track is incorporated with the fixed track so to prevent the mobile track from retraction, or the mobile track is retained in relation to the fixed track to prevent the former from being disengaged from the latter and a further release operation is provided to disengage the mobile track. Many improvements have been made and granted with or pending applications as taught in U.S. Pat. No. 6,367,899 (Taiwan Utility Model No. 190765), U.S. Pat. No. 6,412,891 (Taiwan Utility Model No. 191092), Taiwan Utility Model Nos. 215620, 216738, and 216739, and Taiwan Patent Application No. 092206231 (Publication No. 589968).

Whereas depending on the nature of the application of the slide, the mechanical demands on the slide varies. Therefore, the development of an even more appropriate product is necessary. The present invention differs from those patents cited above in that the positioning function to prevent the mobile track from being retracted is designed with a feature of "mandatory release" to facilitate the retraction of the mobile track.

SUMMARY OF THE INVENTION

The primary purpose of the present invention is to provide a positioning device for a slide that can be automatically released. That is, a mobile track of the slide when extended is restricted from being easily retracted into a fixed track, and later the transient positioning can be forcibly released by applying a certain extent of push force to push the mobile track into the fixed track for retraction.

To achieve the purpose, a two-stage slide comprises a mobile track and a fixed track. A slide piece is provided to the mobile track to produce a transient upholding effect to a retainer disposed on the fixed track. The slide piece is flushed against the inner side of the mobile track and has two axial bolts respectively penetrating through a slide channel and a guide channel of the slide piece while the slide piece is free to deviate and slide. Both sides of the slide piece are respectively folded into a lip. One end of one lip is connected to one end of an elastic member, and the other end of the elastic member is connected to a hooking protrusion extending from the mobile track to draw and maintain the slide piece in a constant status of exercising elastic travel. Another lip of the slide piece is further partially extending a protrusion with a dropped edge on its external end and a hypotenuse on its internal end. One or both sides of the retainer are provided with a retaining plate in relation to the protrusion of the slide piece. Accordingly, once the mobile track is pulled outwardly, the slide piece swings to the edge of the retaining plate of the retainer and swings back to position to force the mobile track to slide into the fixed track, then the slide piece is urged to automatically retreat for clearing out of the retaining plate for a fast retraction of the mobile track.

DETAILED DESCRIPTION OF THE PREFERRED EMBODIMENTS

Figure 1:
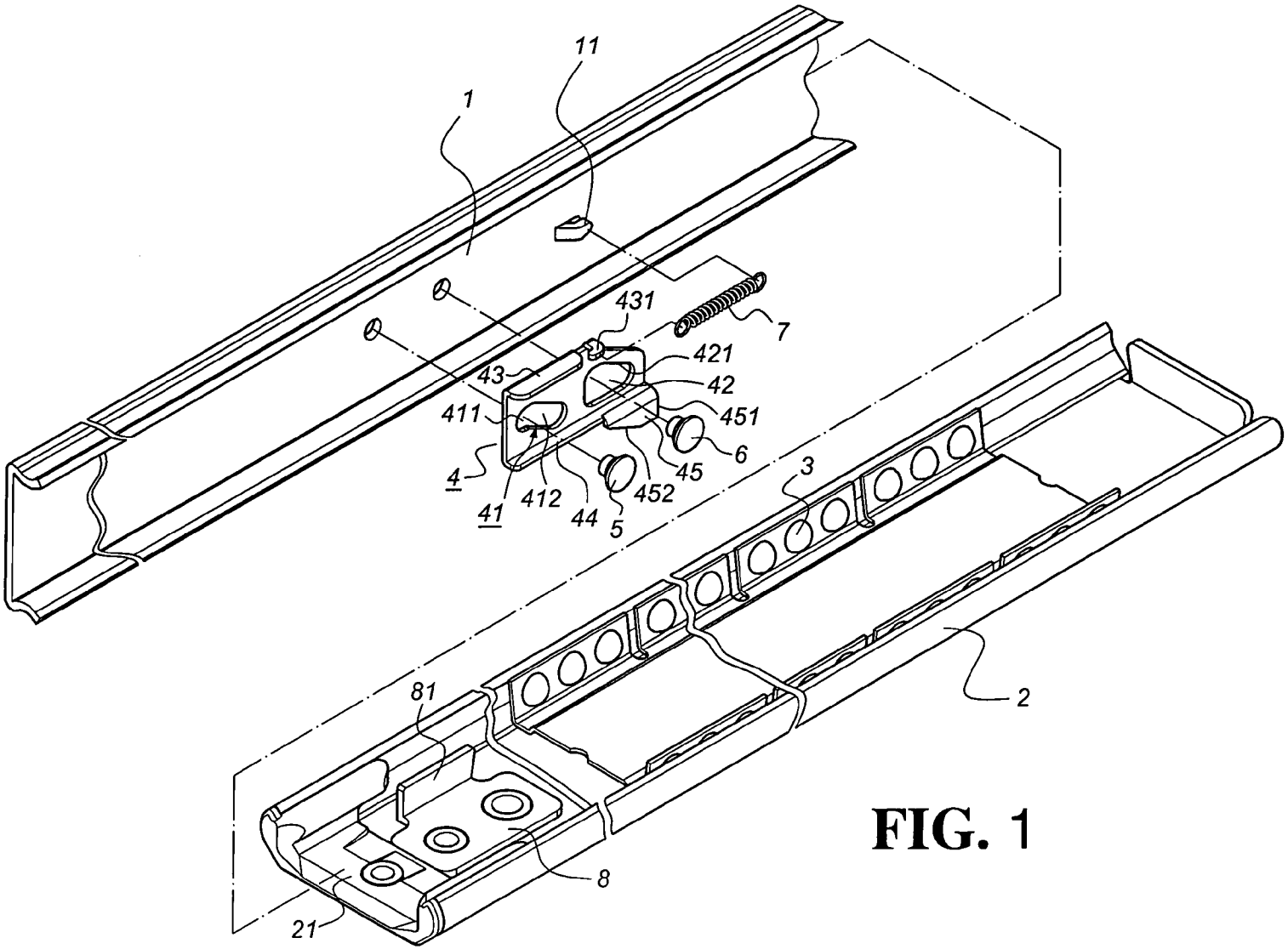
FIG. 1 is an exploded view showing a preferred embodiment of the present invention.

Referring to FIG. 1, a preferred embodiment of a positioning device for a two-stage slide comprises a mobile track (1) sliding into a fixed track (2) provided with an auxiliary slide panel (3) inside the fixed track (2) and a support holder (21) at one end of the fixed track (2) receiving the slide in by the mobile track (1). The mobile track (1) by taking advantage of the ball bearing pattern of the auxiliary slide panel (3) slides in relation to the fixed track (2). The extension of the mobile track (1) in relation to the fixed track (2) is adapted with a design to prevent the mobile track (1) disengaging from the fixed track (2). However, it is to be noted that the prevention design is not the subject of the improvement made by the present invention and will not be elaborated in the description of the primary preferred embodiment and its accompanying drawings (FIGS. 1 through 7), but is cited in the secondary accompanying drawings (FIGS. 8, 9, and 10) wherein a feasible design is disclosed for reference and elaboration of related changes. Furthermore, the feasible preferred embodiments given for the design of the disengagement prevention design shall not in any way restrict the claims to be claimed in the present invention.

A slide piece (4) for restriction provided on the mobile track (1) is flushed against the inner side of the mobile track (1) and located in relation to the external end of the fixed track (2) when the mobile track (1) is extended. The slide piece (4) is provided with a slide channel (41) and a guide channel (42) respectively for the insertion of two axial bolts (5), (6) for the slide piece (4) to swing and slide. The slide channel (41) includes a pivot section (411) and a slant section (412) connecting to each other. The guide channel (42) is a roughly triangular channel with both the X and Y axial distances in the space of the guide channel (42) greater than the diameter of the axial bolt (6) in cross-section. Both sides of the slide piece (4) flushed against the mobile track (1) are each folded into a lip (43), (44). One end of the lip (43) is connected to an elastic member (7). The end of the lip (43) may be made a hook (431) for the elastic member (7) to hook on. Another end of the elastic member (7) is connected to a hooking protrusion (11) provided on the mobile track (1) so that the slide piece (4) for being subject to the draw by the elastic member (7) is in a constant status of providing elastic travel with a hypotenuse (421) of the guide channel (42) of the slide piece (4) constantly upholding the axial bolt (6). Another lip (44) of the slide piece (4) is further curved to form a protrusion (45) provided on its external end a dropped edge (451) and on its internal end a hypotenuse (452).

A retainer (8) is fixed on the fixed track (2) in relation to the slide piece (4). One or both sides of the retainer (8) are provided with a raised retaining plate (81) in relation to the protrusion (45) of the slide piece (4).

Figure 2:
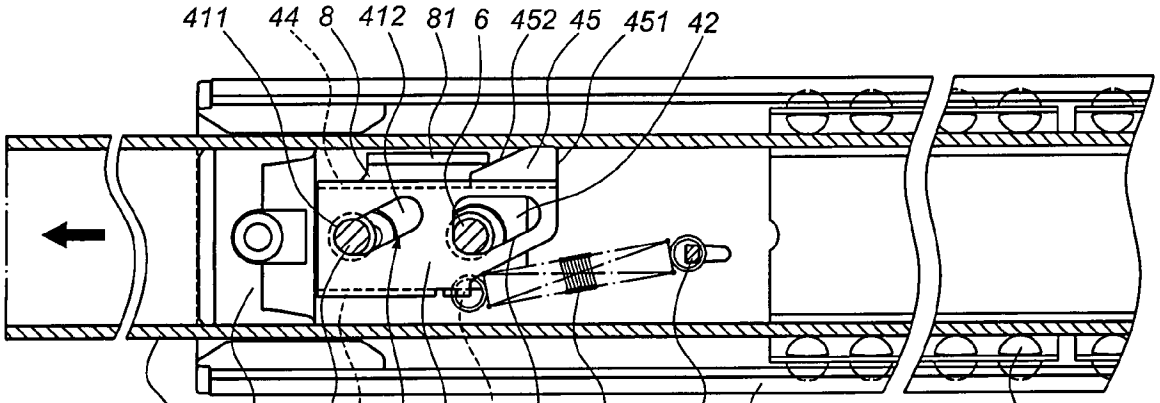
FIG. 2 is a schematic view showing that the preferred embodiment of the present invention is pulled outwardly.
Figure 3:
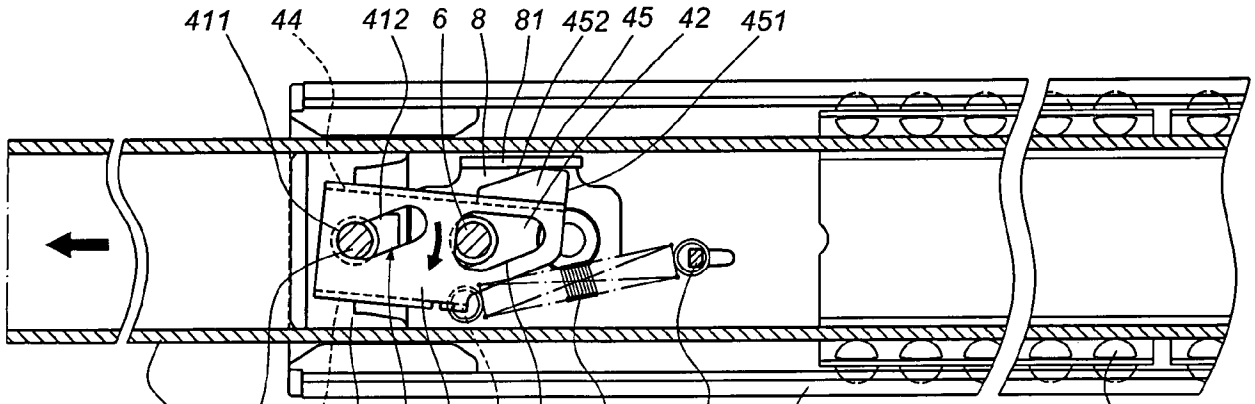
FIG. 3 is another schematic view showing that the preferred embodiment of the present invention is pulled outwardly.
Figure 4:
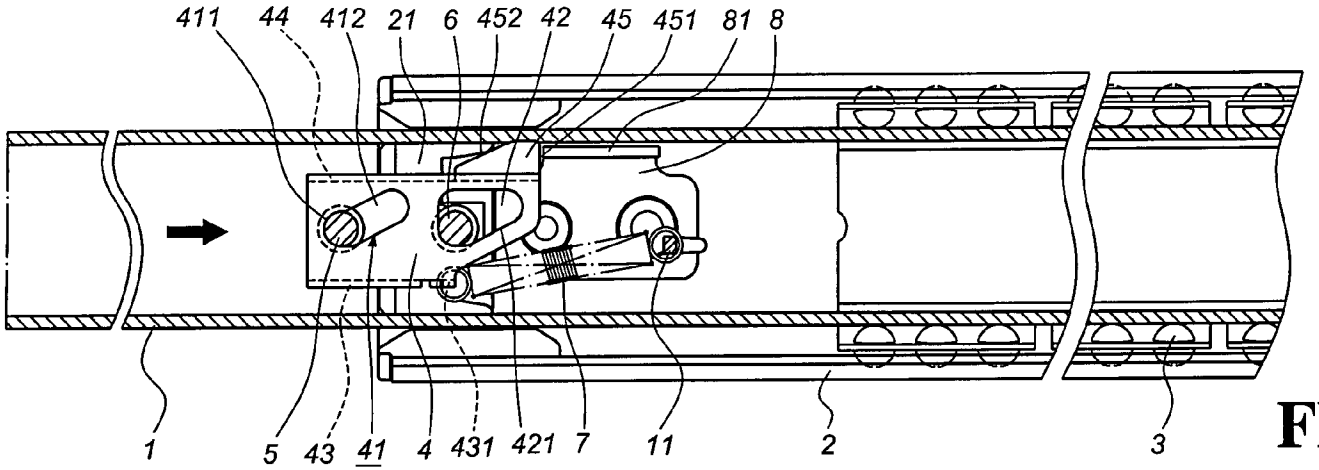
FIG. 4 is a schematic view showing that the preferred embodiment of the present invention is pulled outwardly to stay in position.

When the mobile track (1) is extended, as illustrated in FIGS. 2 and 3, the slide piece (4) travels along with the mobile track (1) to contact the retainer (8) disposed on the fixed track (2). The protrusion (45) on one side of the slide piece (4) has its hypotenuse (452) to uphold the retaining plate (81) of the retainer (8), and later the slide piece (4) with its pivot section (411) in the slide channel (41) and the axial bolt (5) inserted into the pivot section (411) as the axis of rotation automatically slides at a certain inclination. Accordingly, the body of the slide piece (4) is permitted to pass through the retaining plate (81) of the retainer (8) and is secured in place when subject to the pull by the elastic member (7). As illustrated in FIG. 4, with the mobile track (1) fully extended and secured in position, the slide piece (4) has its dropped edge (451) of the protrusion (45) to hold against the external end of the retaining plate (81) of the retainer (8) at the same time, thus to apply a proper resistance against the inward push for preventing the mobile track (1) to easily retract into the fixed track (2).

Figure 5:
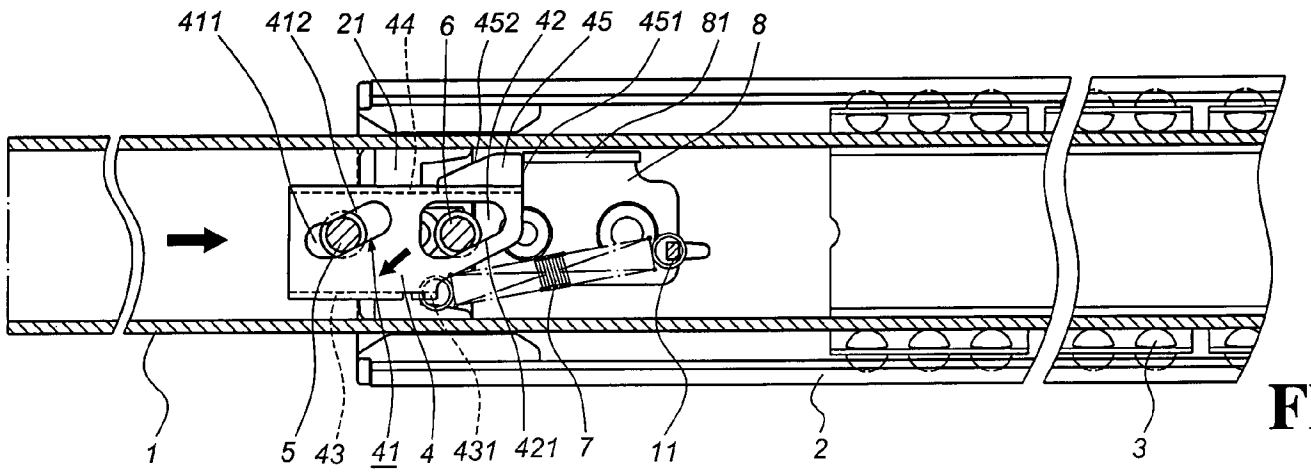
FIG. 5 is a schematic view showing that the preferred embodiment of the present invention is pushed by force into a mobile track.
Figure 6:
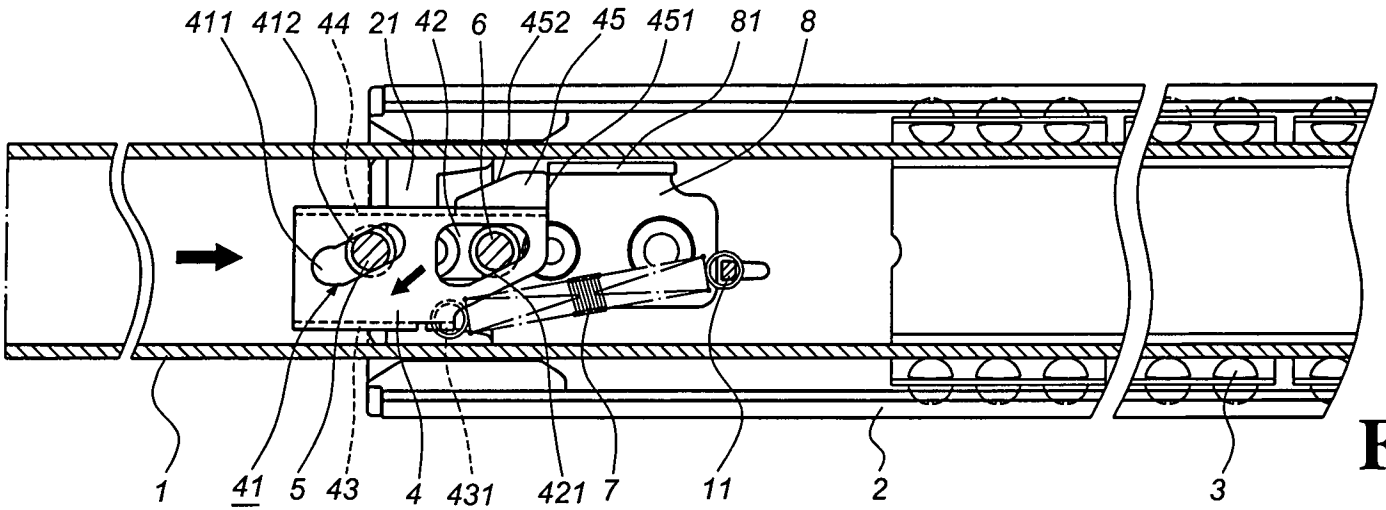
FIG. 6 is another schematic view showing that the preferred embodiment of the present invention is pushed by force into the mobile track.
Figure 7:
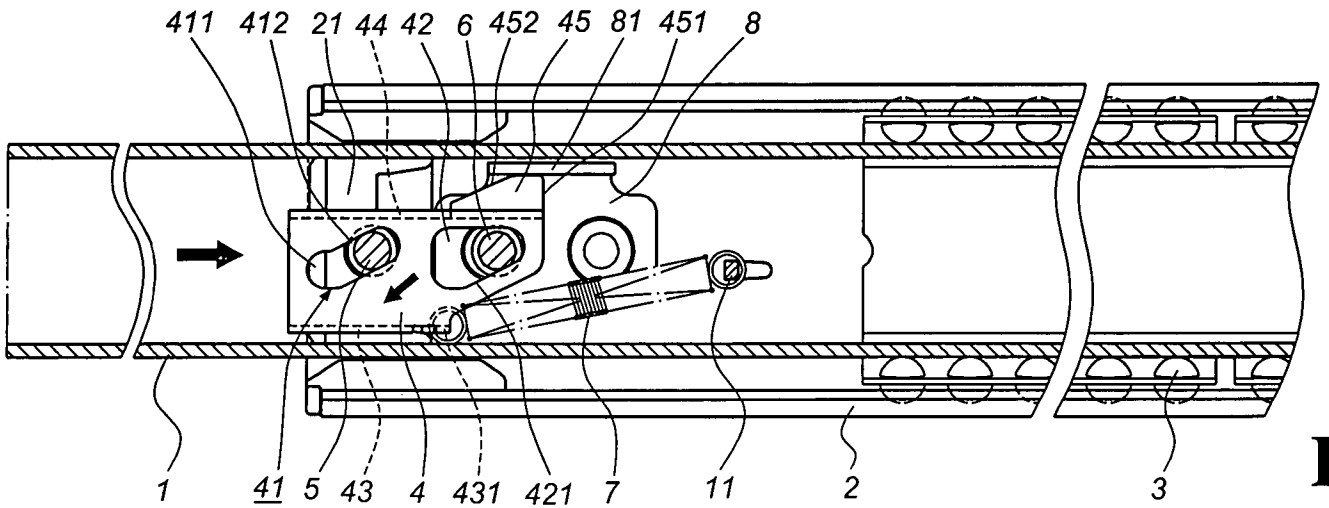
FIG. 7 is another schematic view yet showing that the preferred embodiment of the present invention is pushed by force into the mobile track.

Even the mobile track (1) is under the transient restriction due to the resistance against the inward push as the dropped edge (451) of the protrusion (45) of the slide piece (4) holds against the retaining plate (81) of the retainer (8). The restriction can be automatically released simply by applying a slightly greater force to push in the mobile track (1) (an instantaneous push against the mobile track (1) is preferred in practical use) if the retraction of the mobile track (1) is desired. As illustrated in FIGS. 5, 6, and 7, the mobile track (1) is first slightly pushed in with the protrusion (45) of the slide piece (4) upholding the retaining plate (81) of the retainer (8), and then immediately, the mobile track (1) continuing to move inwardly has its axial bolts (5, 6) sliding against the slant section (412) in the slide channel (41) and the hypotenuse (421) in the guide channel (42) to force the slide piece (4) to move downwardly at a certain inclination (in the direction as indicated by the arrow) for the dropped edge (451) of the protrusion (45) of the slide piece (4) to descend and depart from the contact with the retaining plate (81) of the retainer (8). The slide piece (4) has its protrusion (45) sliding and passing through the inner side of the retaining plate (81) of the retainer (8). Accordingly, the restriction applied by the slide piece (4) is immediately released to continue push in the mobile track (1) to be retracted into the fixed track (2).

Figure 8:
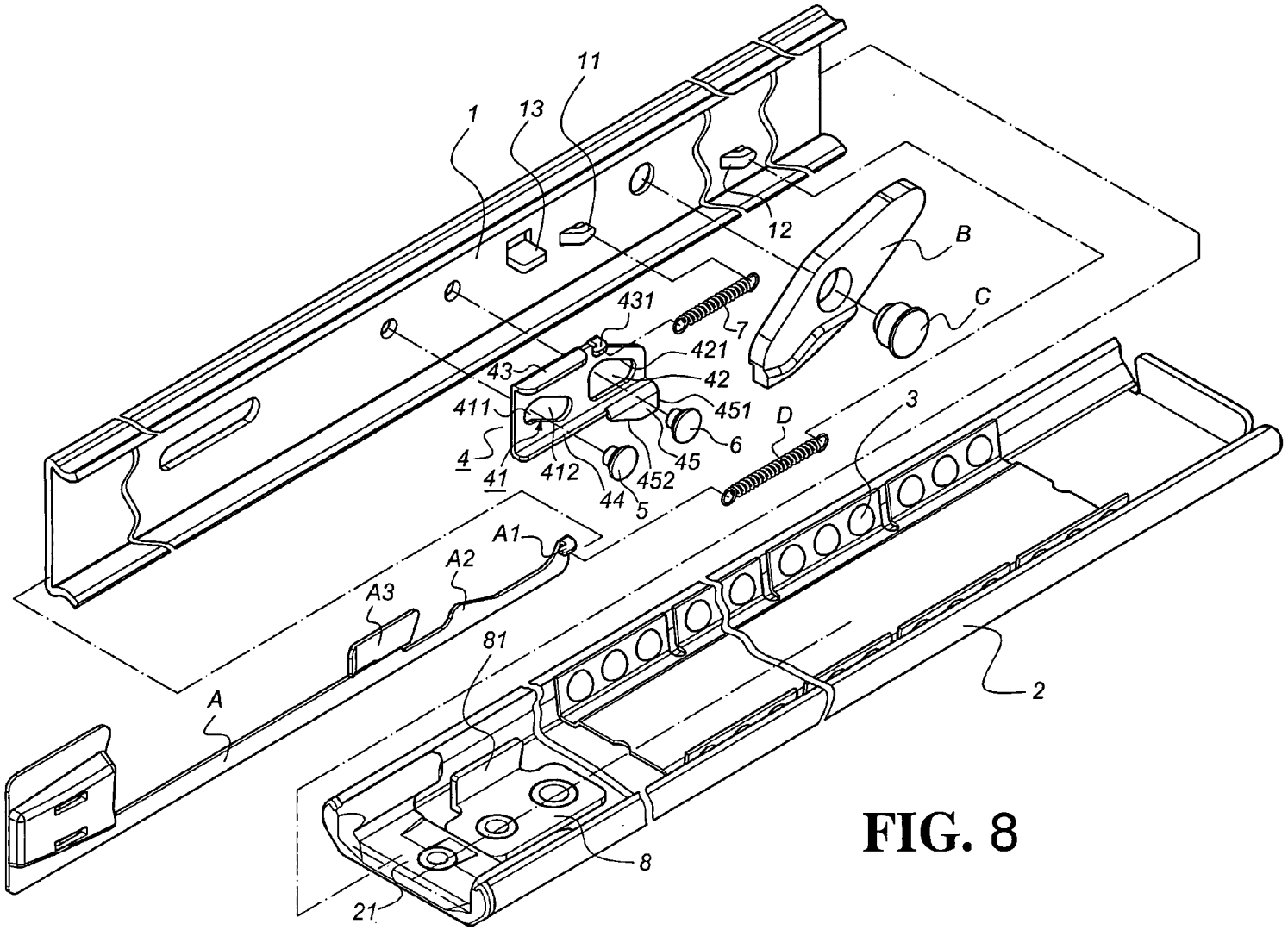
FIG. 8 is a schematic view showing the operation of the preferred embodiment of the present invention adapted with a release mechanism.
Figure 9:
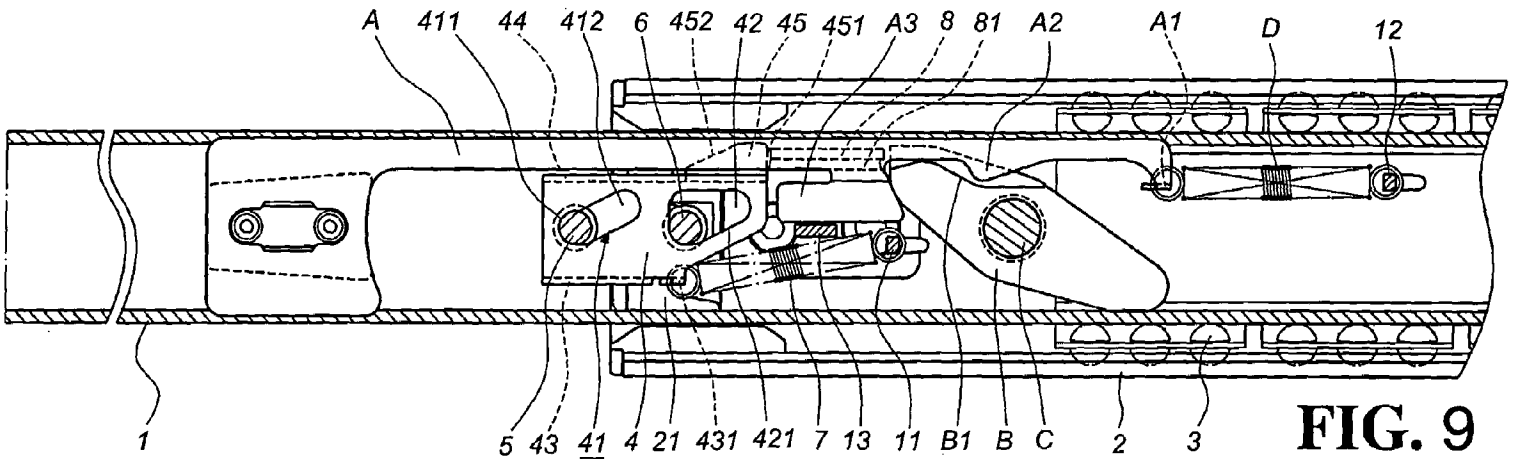
FIG. 9 is a schematic view showing that the preferred embodiment of the present invention adapted with the release mechanism is pulled outwardly in position.

In the design for preventing the mobile track (1) fully extended in relation to the fixed track (2), should the U.S. Pat. No. 6,412,891 titled "RELEASE MECHANISM FOR TELESCOPING SLIDE ASSEMBLY" granted to the same applicant of this present invention be applied to the present invention as illustrated in FIG. 8, a pull rod (A) is inserted into the mobile track (1) with the body of the pull rod (A) penetrating the edge on one side of the protrusion (45) of the slide piece (4). A hook (A1) is formed at the inner end of the body of the pull rod (A) to hook onto an elastic member (D). Another end of the elastic device (D) is connected to another protrusion (12) in hook shape deposed on the inner side of the mobile track (1). Accordingly, the pull rod (A) for being subject to the draw by the elastic member (D) is automatically and constantly held in place. A protrusion (A2) extends from the pull rod (A) close to the hook (A1) and a safety plate (A3) is formed next to the protrusion (A2) and away from the hook (A1). A portion of the safety plate (A3) is in relation to the protrusion (45) of the slide piece (4). A retaining plate (13) is disposed on the inner side of the mobile track (1) in relation to the edge of the safety plate (A3). An axial bolt (C) is used for the inner side of the mobile track (1) to be pivoted to a rotary retaining block (B). One side of the rotary retaining block (B) is recessed to define an oblique wall (B1) in relation to the protrusion (A2) of the pull rod (A) as illustrated in FIG. 9. Accordingly, when the mobile track (1) is fully extended and secured in position, the mobile track (1) is prevented from retracting due to the resistance against inward push as the dropped edge (451) of the protrusion (45) of the slide piece (4) upholds the external end of the retaining plate (81) of the retainer (8). Meanwhile, by having the end of the rotary retaining block (B) to uphold the inner end of the retaining plate (81) of the retainer (8) also achieves the same purpose of keeping the mobile track (1) not to disengage from the fixed track (2).

Figure 10:
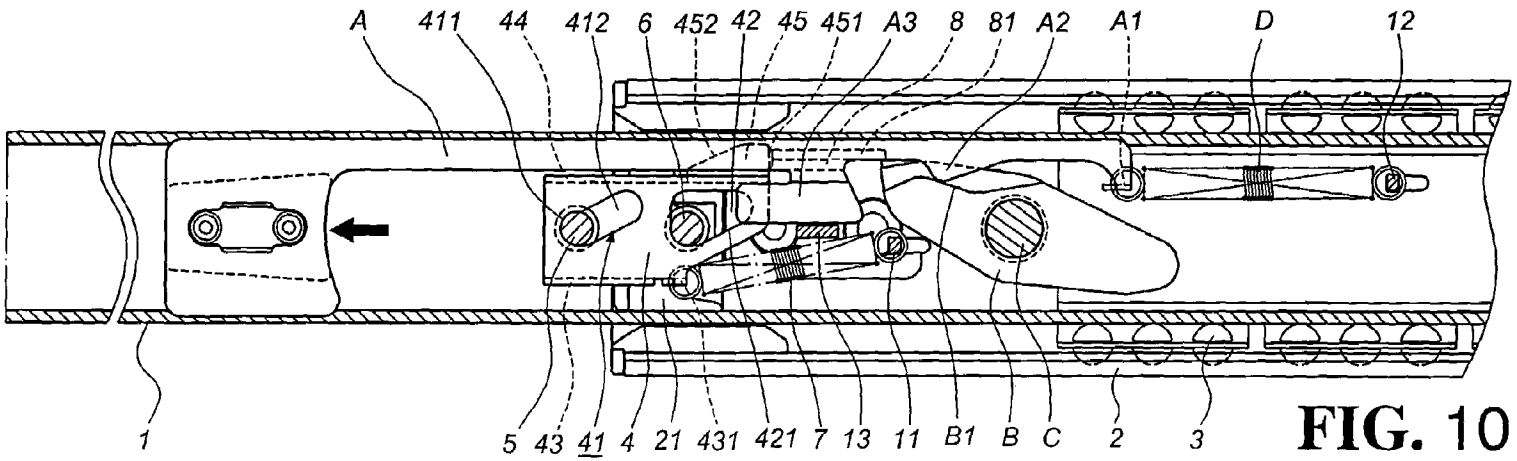
FIG. 10 is a schematic view showing that the preferred embodiment of the present invention adapted with the release mechanism is released from its positioning status.

Furthermore, if the removal of the mobile track (1) to completely pull out it from the fixed track (1) as illustrated in FIG. 10, the pull rod (A) is pulled for the protrusion (A2) of the pull rod (A) to be pushed against the oblique wall (B1) of the rotary retaining block (B) for the rotary retaining block (B) to immediately deviate its end from the retaining plate (81) to permit the mobile track (1) to be pulled out. Upon pulling the pull rod (A), the safety plate (A3) travels in relation to the end of the protrusion (45) of the slide piece (4) thus to uphold the slide piece (4) to prevent it from deviation while helping the retaining plate (13) provided on the inner side of the mobile track (1) to hold against the edge of the safety plate (A3) for increasing the reliable holding to allow the slide piece (4) to firmly uphold the retaining plate (81) and make the forced release impossible. The primary purpose of the design is to make sure that when a user has his/her fingers to pull the pull rod (A), the mobile track (1) is prevented from being pushed inwardly for retraction, thus to avoid possible injury of the fingers when accidentally caught in the space between the mobile track (1) and the fixed track (2).

What is claimed is:

1. A positioning device for a slide comprising a fixed track, a mobile track slidingly engaged with the a fixed track, and an auxiliary slide panel disposed inside the fixed track;

the mobile track being provided with a slide piece for preventing disengagement of the mobile track from the fixed track, the slide piece being disposed flush against an inner side of the mobile track and located in relation to an external end of the fixed track when the mobile track is extended, a slide channel and a guide channel being disposed on the slide piece, two axial bolts respectively penetrating through the slide and the guide channels and fixed to the mobile track, the slide piece deviating and sliding on the mobile track, one end of one side of the slide piece being connected to one end of an elastic member, another end of the elastic member being connected to the mobile track, the slide piece being displaceable by the elastic member and given a constant and elastic travel, an inner side of the guide channel of the slide piece constantly upholding the axial bolt inserted into the guide channel, and a protrusion being extended from another side of the slide piece;

a retainer being fixed on the fixed track in relation to the slide piece and having opposing upper and lower edges, at least one or both of the upper and lower edges of the retainer being provided with a raised retaining plate in relation to the protrusion of the slide piece; and the slide piece with the slide channel and the axial bolt inserted into the slide channel as an axis of rotation being automatically displaced to slide over the retainer responsive to the mobile track being pulled outwardly, with the mobile track being fully extended the slide piece is secured in place by having the protrusion holding against an external end of the retaining plate of the retainer, responsive to the mobile track being pushed in by force, the slide piece is pushed to automatically slide and disengage from the retaining plate of the retainer to retract the mobile track into the fixed track.

2. The positioning device for a slide of claim 1, wherein the slide channel of the slide piece comprises a pivot section and a slant section connecting to each other; the guide channel being substantially triangularly shaped with a hypotenuse on an inner side thereof, and both an X and a Y axial distance in the space of the guide channel being greater than a diameter of the axial bolt.

3. The positioning device for a slide of claim 1, wherein one end of one side of the slide piece is provided with a hook to engage the one end of the elastic member, and the other end of the elastic member is hooked on a hooking protrusion provided on the inner side of the mobile track.

4. The positioning device for a slide of claim 1, wherein the protrusion of the slide piece is provided with a dropped edge on an external end and a hypotenuse on an internal end.

* * * * *